United States Patent [19]

Kramer

[11] Patent Number: 5,009,320

[45] Date of Patent: Apr. 23, 1991

[54] PACKAGING CARTON

[76] Inventor: William I. Kramer, 103 Briarcliff Dr., Ossining, N.Y. 10562

[21] Appl. No.: 607,242

[22] Filed: Oct. 31, 1990

[51] Int. Cl.[5] ..... B65D 5/54

[52] U.S. Cl. ..... 206/607; 206/611; 206/614; 206/625

[58] Field of Search ..... 206/607, 611, 614, 625, 206/628

[56] References Cited

U.S. PATENT DOCUMENTS

| | | | |
|---|---|---|---|
| 2,973,086 | 2/1961 | Thompson | 206/607 |
| 3,797,728 | 3/1974 | Buttery et al. | 206/625 |
| 4,043,503 | 8/1977 | Meyers et al. | 206/625 |
| 4,746,019 | 5/1988 | Prater | 206/607 |
| 4,919,785 | 4/1990 | Willey et al. | 206/625 |

*Primary Examiner*—Gary E. Elkins
*Assistant Examiner*—Christopher McDonald
*Attorney, Agent, or Firm*—McAulay Fisher Nissen Goldberg & Kiel

[57] ABSTRACT

A carton for containing food suitable for microwaving, having a pair of spaced end walls coupled with a base, a top closure wall and a side wall for each end wall of the pair of end walls adapted to fit thereover, tear portions on each of the side walls for dividing thereof into first and second portions, and seals for sealing the side walls with the end walls, the second portions being separable from the first portions to form handles for supporting the carton.

20 Claims, 7 Drawing Sheets

PACKAGING CARTON

BACKGROUND OF THE INVENTION

1. Field of the Invention

This invention relates to a food container provided with handles for lifting and/or supporting thereof.

More particularly, the present invention is concerned with a container for containing foods adapted to be heated in a microwave oven. The container is provided with handles or support members converted from an existing portion of the carton structure.

The temperature of the handles, after the carton is removed from the microwave oven, is not cool, but is somewhat higher than room temperature, yet the handles are comfortable to the touch.

2. Description of the Prior Art

Microwavable gable style cartons, both top and end loaded, are currently being utilized for microwavable food preparation and heating.

In a top loaded carton, the gable corners have to be sealed. For an end loaded carton, the gable corners do not have to be sealed.

Conventionally, a carton is either an end loaded style or a top loaded style carton which is loaded with bulk or pouched products prior to sealing the carton, and the carton's structure is designed and intended to be heated in a microwave oven. Once the carton and contents are prepared for microwaving, the carton is placed into the oven and subjected to a heating cycle. Following completion of the heating cycle, the container is removed from the microwave oven.

These cartons, however, once heated, are extremely cumbersome and hot to handle when removed from the microwave oven or heating source. Since current carton designs do not employ handles or lifting members to assist in handling, the cartons must be removed from the oven utilizing some form of gripping utensil or hand protection to keep a food handler from being burned by the hot carton.

The container is conveniently formed from a single board or cardboard member, as done heretofore, which may be provided with a single coating or a double coating of polyethylene or polypropylene. The carton board is a solid bleached sulfate board which is the conventional standard kind of board in the art.

In order to print graphics onto the container, as done heretofore, the coating is extruded onto the paper at the mill and then printing takes place o top of the coating.

DESCRIPTION OF THE INVENTION

The invention is concerned with utilizing a carton flap structure present on both existing microwavable top load and end load gable cornered style cartons for the purpose of forming or converting lifting handles out of the end flaps, thus enabling the container, once heated, to be safely and conveniently removed from the microwave oven. These handles or lifting members are readily converted by uniquely utilizing both upper end flaps and top flap carton structure through a combination of specially configured cuts and perforations.

With the provision of handles or lifting members, it is possible to manufacture the container both by heat sealing and gluing.

The present invention proposes to provide the carton with lifting handles or lifting members and to utilize the carton's lifting handles or lifting members to help remove the carton from the microwave oven. Since these lifting handles or lifting members are first positioned away from the body of the carton, any heat transfer to these handles or members is significantly lower than the temperature of the carton body itself. As a result, the heated carton may be safely and conveniently removed from the microwave oven.

To these ends, the present invention consists in the provision of a carton for containing food suitable for microwaving, wherein the carton includes a front and a rear upstanding wall coupled with a base member or walls, a pair of spaced upstanding end walls connected with the front and rear walls and connected with the base member or wall, a top or lid closure wall connected with the rear wall and including three flap walls coupled thereto, one for the front wall and one for each end wall of the pair of end walls adapted to fit over the front wall and the pair of end walls, perforations on at least two of the flap side walls for dividing the flap side walls into first and second portions, the first portions being sealed to their respective end walls and leaving the second portions free of sealing engagement with their respective end walls, the perforations enabling the second portions to be separated from the first portions to form handles or lifting members for supporting the carton.

The second portions forming handles or lifting members which may be suitably separated from the first portions before the carton is placed into the microwave oven. The front wall may also be made from first and second portions which are separated from each other so that the second portion can form a top lid opening member. For this purpose, the first and second portions are connected together by means of perforations and a part of the top wall may be underscored as an alternate to perforations or tear lines to provide for a center member to be separated from two top side members to open the carton. The two top side members are connected with the end walls along score lines so that the end walls can pivot relative to its attached side member.

The invention is also concerned with a carton for containing food suitable for microwaving and includes a food container having a tray portion provided with a pair of spaced end walls, a front and a rear wall; the food container includes sealing portions or members for sealing the tray portion to prevent contamination thereof, and includes a cover and members having a first part forming seals with the spaced end walls and a second part which includes holding portions and lifters for the holders to separate them from the carton end walls. The first part is adjacent to the end walls in a transport condition of the tray portion as well as in the support or holding condition, and the second part is connected with the cover and is pivotally connected with the cover so that it is pivotably connected with the cover and pivotable relative to the end walls towards and away therefrom and towards and away from the first member for support of the tray portion.

The invention is also concerned with a carton blank for forming a microwavable container, comprising a single blank element having a base member and four base side members coupled with the base member, one of the base side members forming a front base side member, a second forming a rear base side member, and the remaining two forming spaced base end members, score lines between each of the base side members and the base member to permit the base side members to pivot relative to the base member, a top or cover portion and two top end side members pivotally coupled to the top portion, the top portion having a rear side edge between the two top side members pivotally connected to the rear base side member, each of the two top end side members including a pair of spaced tear lines or perforations or serrations to divide the two top end side members into a first portion for lifting a carton formed from the carton blank and a second portion adapted to be connected with and sealed to the base end members. The base end members are parallely spaced from each other when the carton is formed and orthogonal to the other or adjacent base side members.

The handles are scored and perforated or serrated. The handles are scored to permit them to pivot relative to the top portion, and they are perforated or serrated so as to divide the two top end side members into the holding or carrying portion and into the sealing or closure portion. The handles are separated from the end portions along the perforations or serrations and pivot or swing about the score lines relative to the top portion and away or out of the plane of the end side members, since it is necessary to move the handles out of the plane of the ends for use. To permit rotation, one edge of the handle portions are scored at the portion thereof where the handle portions are connected to the top of the container, which top is connected to the two end portions and the two side portions. Another edge of the handle portions are scored to divide the handle portions into support handles and lifting tabs so that the lifting tabs can be used to separate the handles along the perforations and move them out of the plane of the portions sealed against the base end side members.

The top portion also includes cover side members or support braces connected with the handles and provides support for the carton and braces for the handles even in the open condition. The top is underscored and/or perforated to provide a closure portion connected to the cover side members or braces which cooperate with the handles.

BRIEF DESCRIPTION OF THE DRAWINGS

In order that the invention may be more clearly understood and readily carried into effect, the invention will now be described in connection with the accompanying drawings.

DESCRIPTION OF THE PREFERRED EMBODIMENTS OF THE INVENTION

Figure 1:
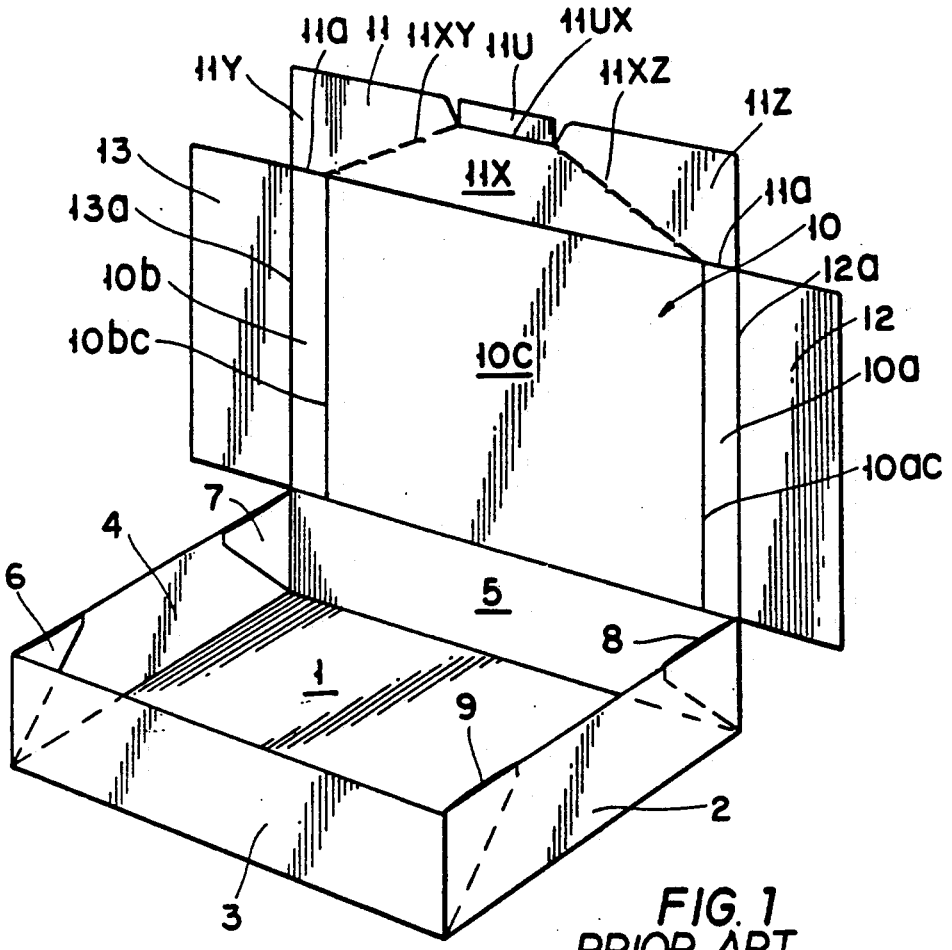
FIG. 1 PRIOR ART
FIG. 1 is a perspective view of a prior art top load carton in a partially assembled condition with the top flap panel open to expose the interior of the carton.
Figure 2:
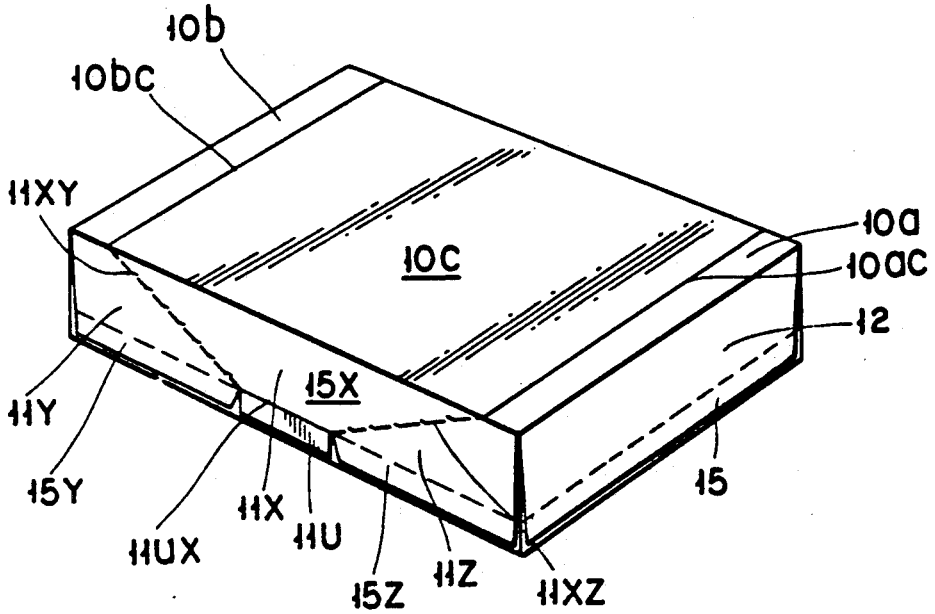
FIG. 2 PRIOR ART
FIG. 2 is a perspective view of a prior art top load carton in an assembled and closed condition.
Figure 3:
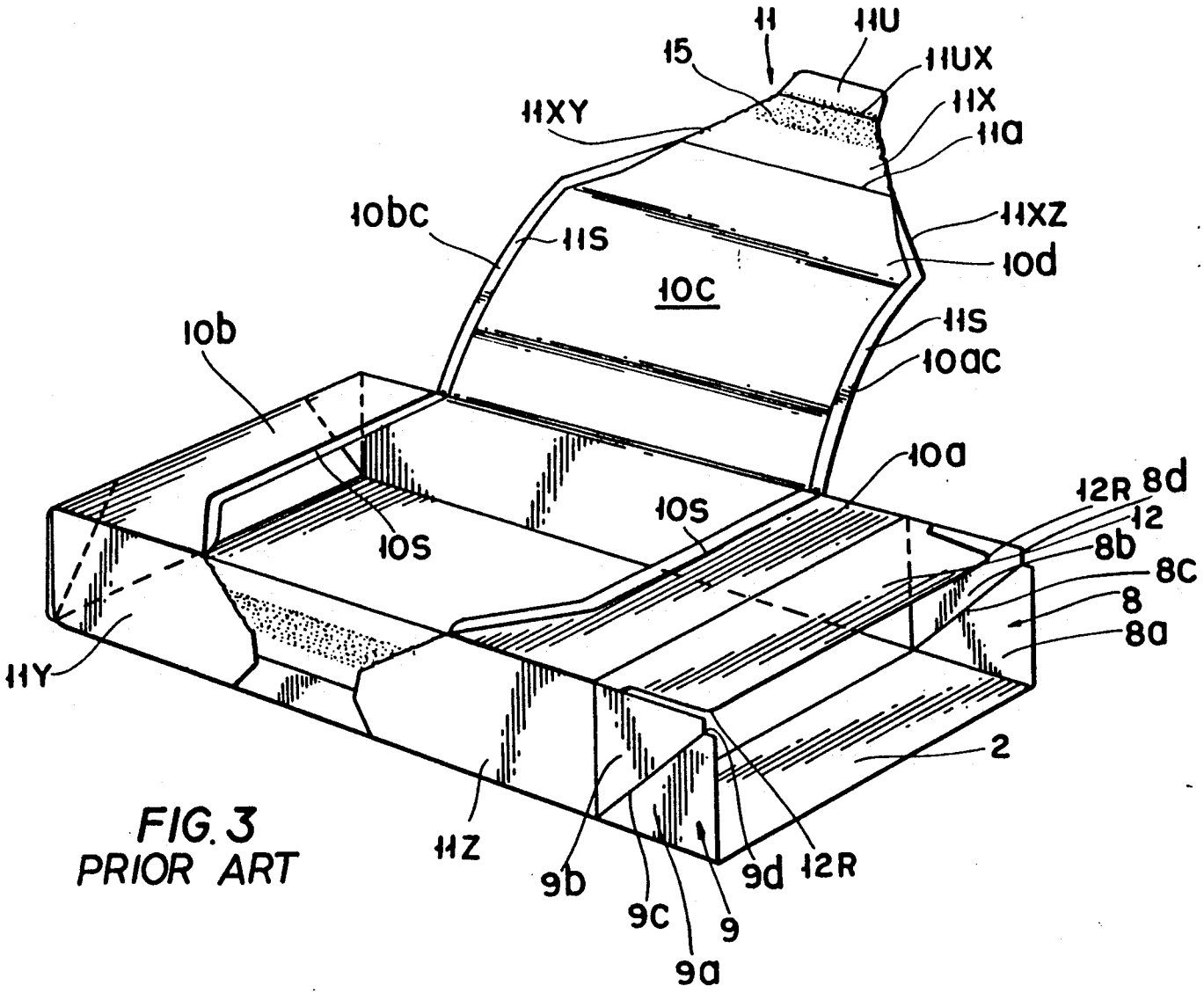
FIG. 3 PRIOR ART
FIG. 3 is a perspective view of a prior art end loaded carton in a partially assembled condition with the top flap opened to expose the interior of the carton.

Referring now to the drawings which shows the presently preferred mode for carrying out the invention and, to emphasize the distinctions between the present invention and the prior art, reference is made to FIGS. 1 and 2 which illustrate a conventional prior art top loaded carton, and FIG. 3 which illustrates a conventional prior art end loaded carton.

FIG. 1 shows a partially assembled carton in an open position for product loading. This carton is the prior art top loaded carton and generally includes a base 1, four base sides 2, 3, 4 and 5, rear base side or wall 5, front base side or wall 3, and base end sides or walls 2 and 4, connection gable corners 6, 7, 8 and 9, and a top closure in the form of a lid portion or cover generally designated 10 and three outer side portions or top cover side portions 11, 12 and 13. Cover side front end portion 11 and side end portions 12 and 13 are connected to the top cover or lid portion 10 and are pivotable about score lines 11*a*, 12*a* and 13*a*, and in a closed condition of top closure 10 overlie the base side portions 3, 2 and 4, respectively, in order to be used to seal the carton.

Gable corner 6 is between sides 3 and 4, gable corner 7 is between sides 4 and 5, gable corner 8 is between sides 5 and 2, and gable corner 9 is between sides 2 and 3.

Top cover portion 10 further includes a center portion 10*c* and top cover side portions 10*a* and 10*b* joined to center portion 10*c* at underscored lines or undercut scoring lines 10*ac* and 10*bc*. Top cover side portions 10*a* and 10*b* provide the connection panels between the cover side end portions 11, 12 and 13 and side end portions 12, 13 which are used to seal the end walls 2 and 4 and side front portion 11 which is used to seal the front end 3 and to open the carton.

The side 11 which is used to open the container as well as to seal the front of the container comprises a center flap 11*x* and two side portions 11*y* and 11*z* joined at tear lines or perforations or serrations 11*xy* and 11*xz* forming perforated or serrated cuts so that 11*x* can be separated from 11*y* and 11*z* by tearing along tear or perforation or serration lines 11*xy* and 11*xz*. In the closed condition, side 11 includes a lift member 11*u* pivotally joined at pivot score line 11*ux* to 11*x* and is used to separate center flap 11*x* from side portions 11*y* and 11*z* along tear or perforation or serration lines 11*xy* and 11xz. Undercut score line or underscored line 10bc is connected with tear line 11xy and tear line 11xz is connected with undercut score or underscored line 10ac to separate cover center portion 10c from cover side portions 10a and 10b. Underscored lines 10ac and 10bc are best seen in FIG. 3 in perspective.

It should be noted that some lines are defined as tear lines, and this refers to a line which is scored and cut so that it has a perforated portion which can be torn along the cut with ease to separate the two adjacent parts on either side of the tear line. Other lines are defined as pivot lines or score pivot lines which are scored to permit the two adjacent members on either side of the score pivot line to be pivotable relative to each other with ease, but not to separate easily. Other lines are defined as undercut score lines to define lines which are used to separate two members, wherein one member is to be physically separated from the other, not done facilely and but which prior to separation provides a uniform and continuous seal as distinguished from perforations which have openings even when the two adjacent members are physically connected and not separated. A line which is not perforated is a score line or an undercut score line. A line which is used to separate two adjacent parts physically is a tear or perforation or serration line but an undercut score line can also be used for this purpose, but separation is somewhat more difficult.

Base sides 2, 3 and 4 of the bottom of the container are sealed to cover side portions 12, 11 and 13, respectively, but lift member 11u which is part of side portion 11 is not sealed to side 3 in order to permit the lift member 11u to move member 11x away from side 3 and to open the container.

Cover side or end portions 12 and 13 are uniform and differ from cover front side portion 11 and are each provided with sealing portions 15 to seal the cover sides 12, 13 to sides 2 and 4 of the bottom of the container. Sealing portions 15y and 15z are also used to seal side portions 11y and 11z to front side 3, but lift member 11u does not have to be sealed to front side 3. Center flap 11x may also have a sealing portion 15x. But, all of side portions 11y and 11z may be sealed or a portion at the bottom similar to lift member 11u may be left unsealed.

Referring now more particularly to FIG. 3 which shows another form of prior art, but this is directed to an end loaded container. The same reference numerals will be used throughout in FIG. 3, cover end portion 12 is also shown as a continuous uniform member which will overlie base end side 2 and it has corners 12r which are slightly rounded to facilitate the closing and sealing after side 2 is folded inwardly and gables 8 and 9 are inwardly folded along fold lines 8c and 9c, respectively, so that gable portions 8a and 8b will overlie each other and gable portions 9a and 9b will overlie each other in a similar manner. The gables associated with side 4 and undesignated will operate in the same manner. Cover side portions 10a and 10b are slightly undercut or underscored at 10s to provide for the opening and the cover center portion 10c also includes a portion of the underscoring at 11s which is undercut so that, in the closed condition, 11s overlies 10s and opening is facilitated while providing a uniform and complete closure before cover center portion 10c is separated from cover side portions. Lines 11xy and 11xz are perforations, serrations or tear lines to separate center flap 11x from side portions 11y and 11z. Line 11ux is a pivot line between center flap 11x and lift member 11u. Center flap 10c may extend between sides 3 and 5 and not access 3 and 5, so that it would extend across 2 and 4.

Figure 7:
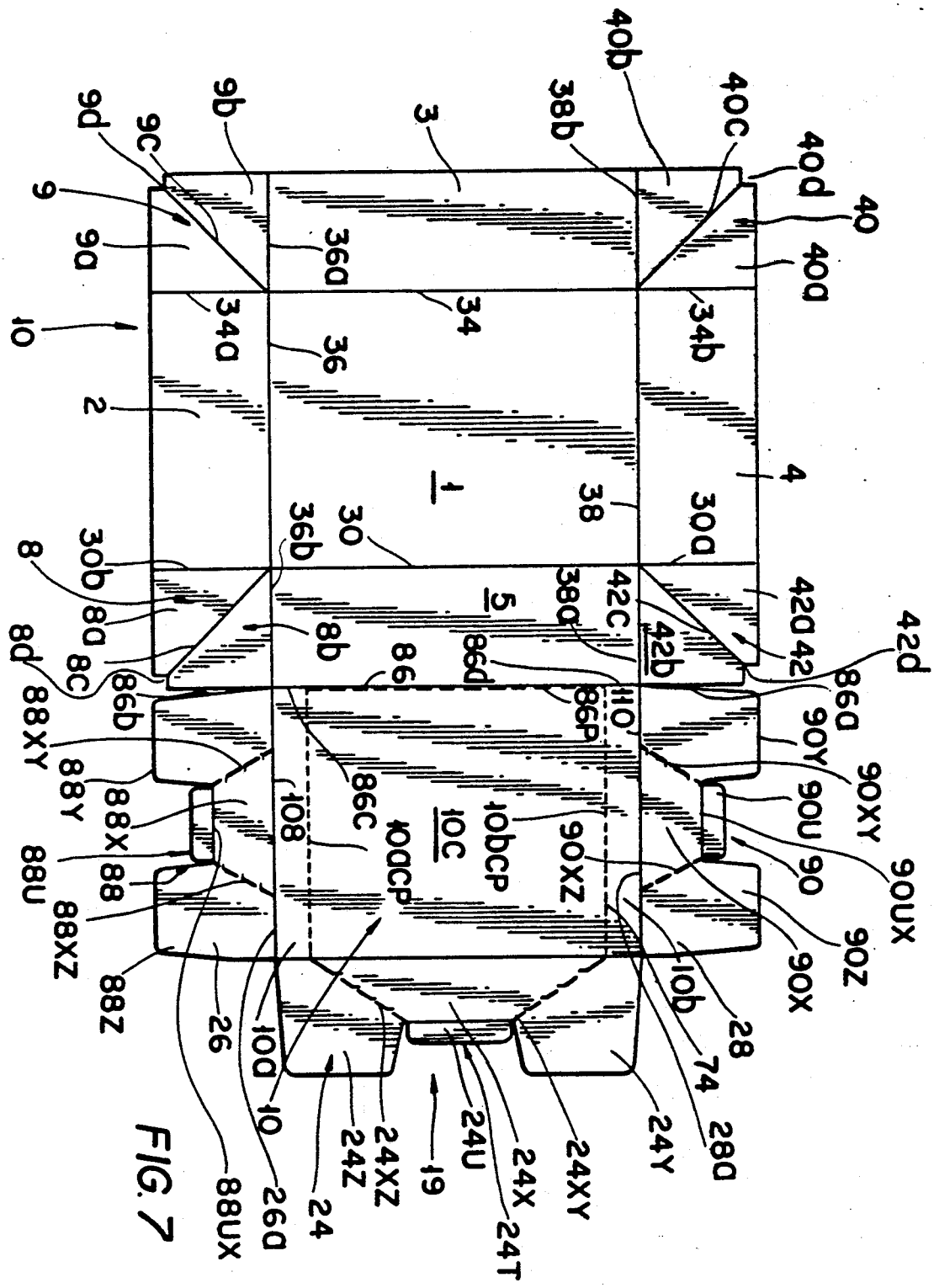
FIG. 7 is a flat plane projection of a carton blank for use in assembling the carton in FIGS. 4 to 6 and 8, 9.
Figure 9:
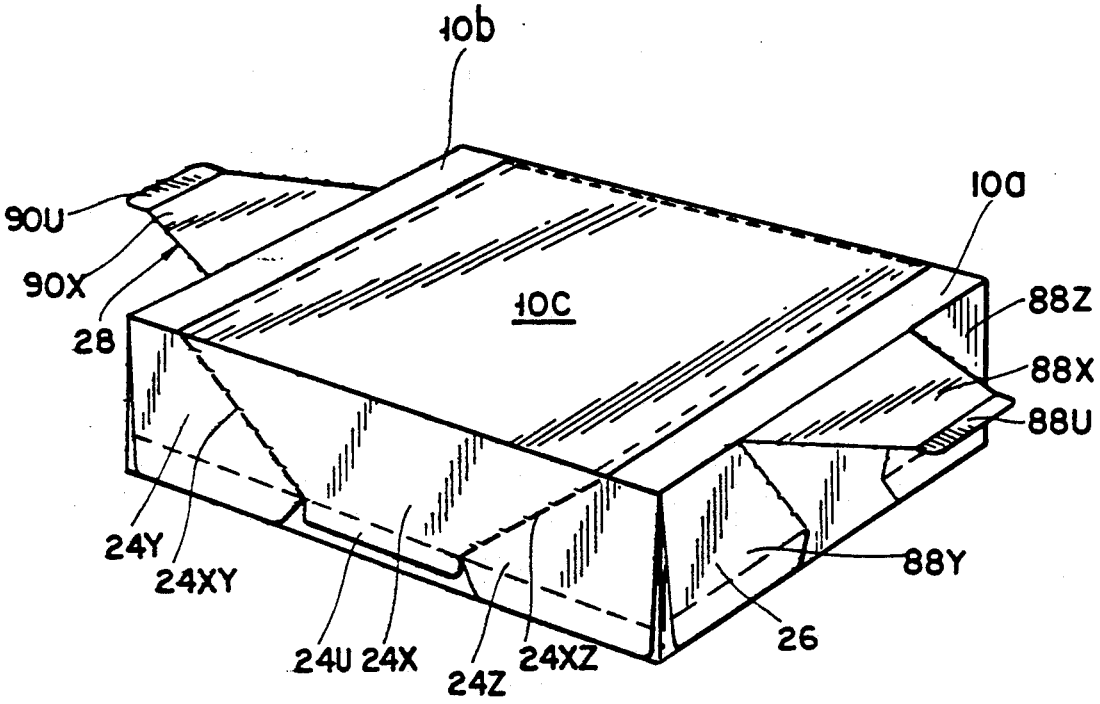
FIG. 9 is a perspective view of the top load carton of FIG. 8 shown in a closed condition in a manner similar to the carton shown in FIG. 1, but in accordance with my invention in an assembled condition, with the handles which are provided for support and removal from the microwave oven shown separated from the base side edges and partially rotated out of the plane of the base side edges.
Figure 6:
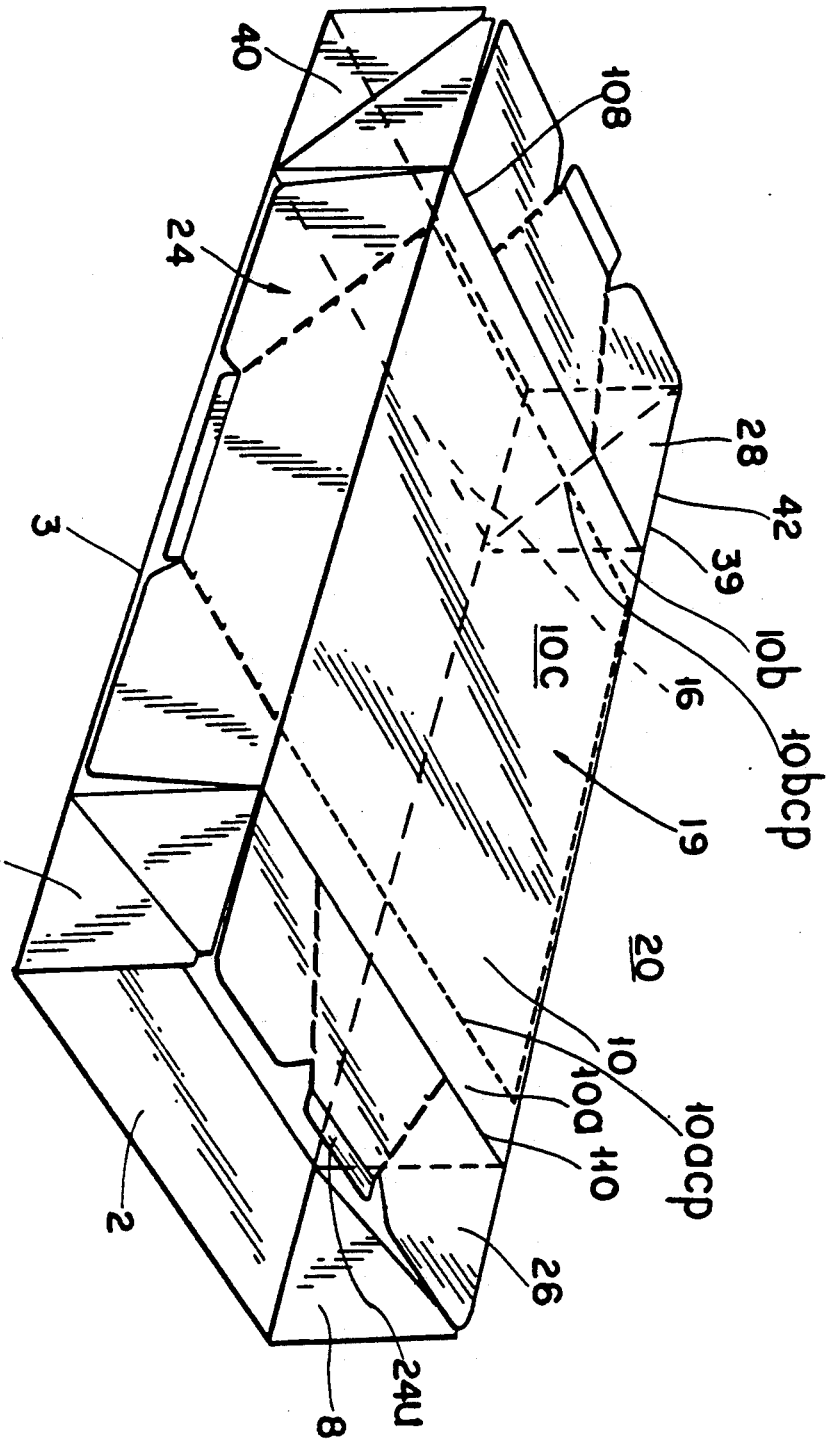
FIG. 6 is a partially assembled end loaded carton in accordance with my invention with the opposite sides open prior to assembly for the insertion of food or loading of food, one side may be closed prior to loading of food.
Figure 8:
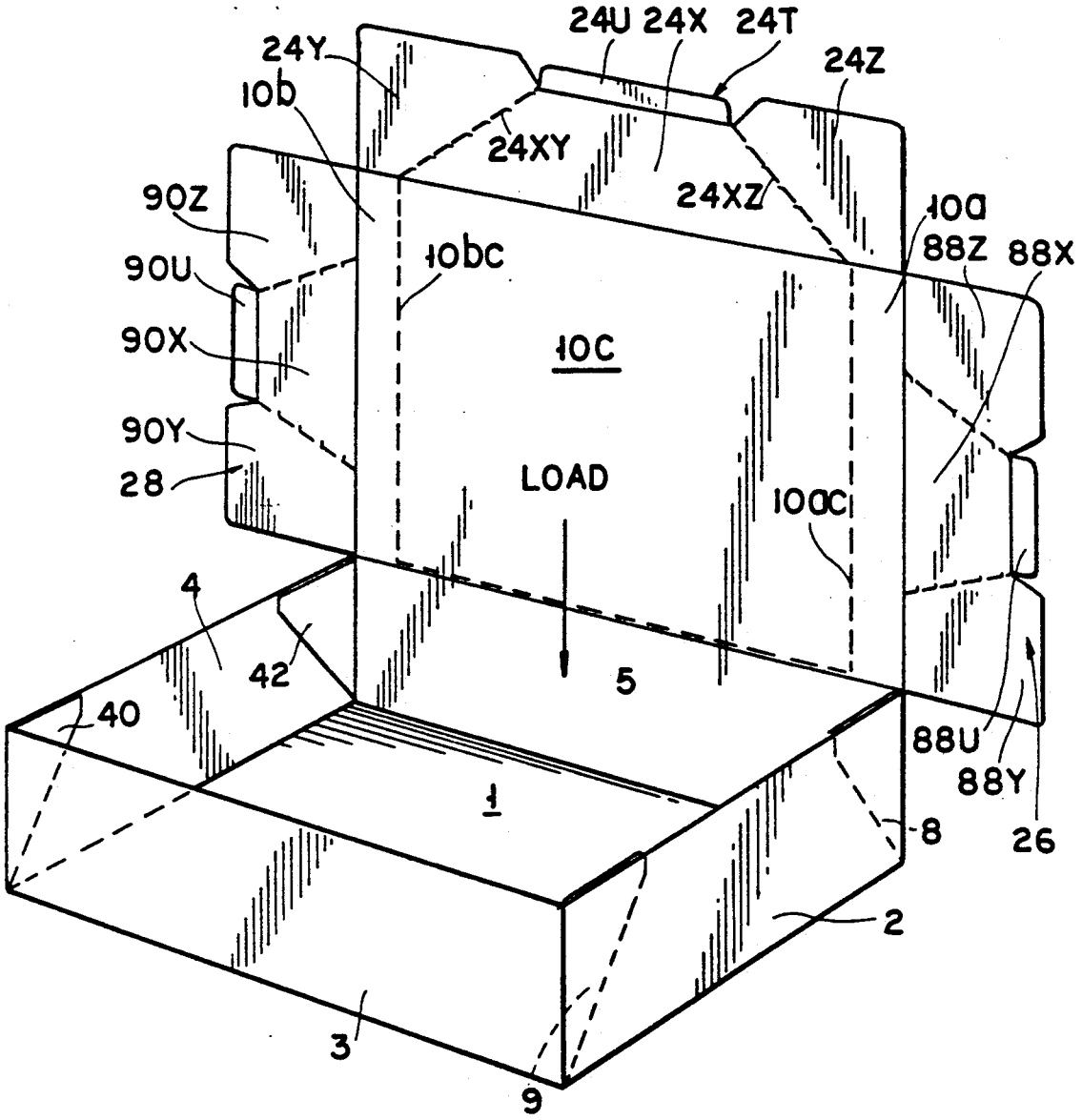
FIG. 8 is a perspective view of a top loaded carton of the gable style in accordance with the invention in which all of the gables of the carton are sealed and in a partially assembled condition with the top flap open in a manner similar to the carton in FIG. 1 to expose the interior of the carton, in accordance with my invention.
Figure 4:
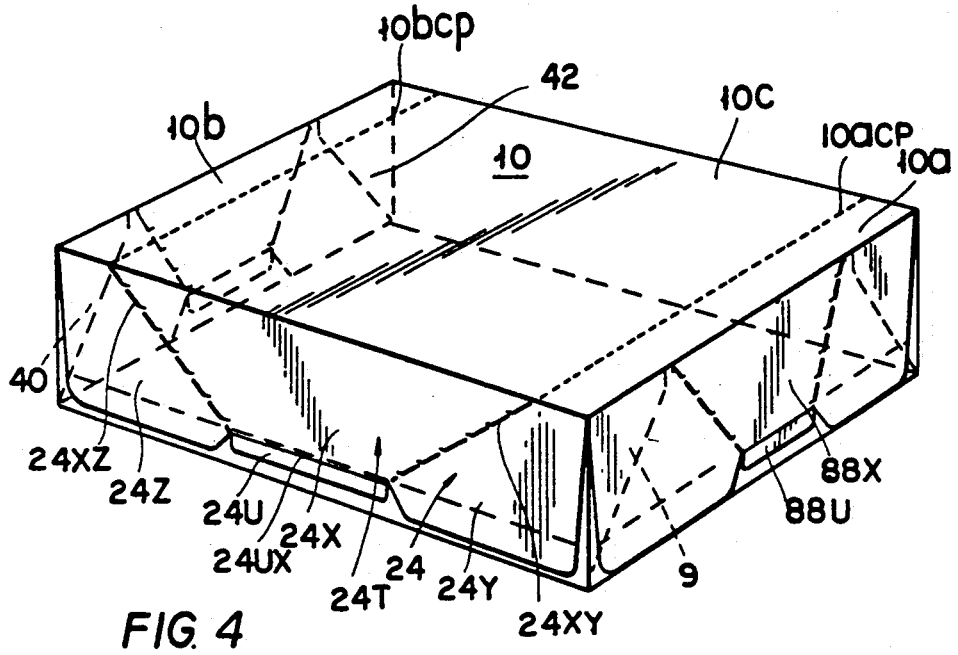
FIG. 4 is a perspective view of an end loaded carton in a fully closed condition in accordance with my invention.
Figure 5:
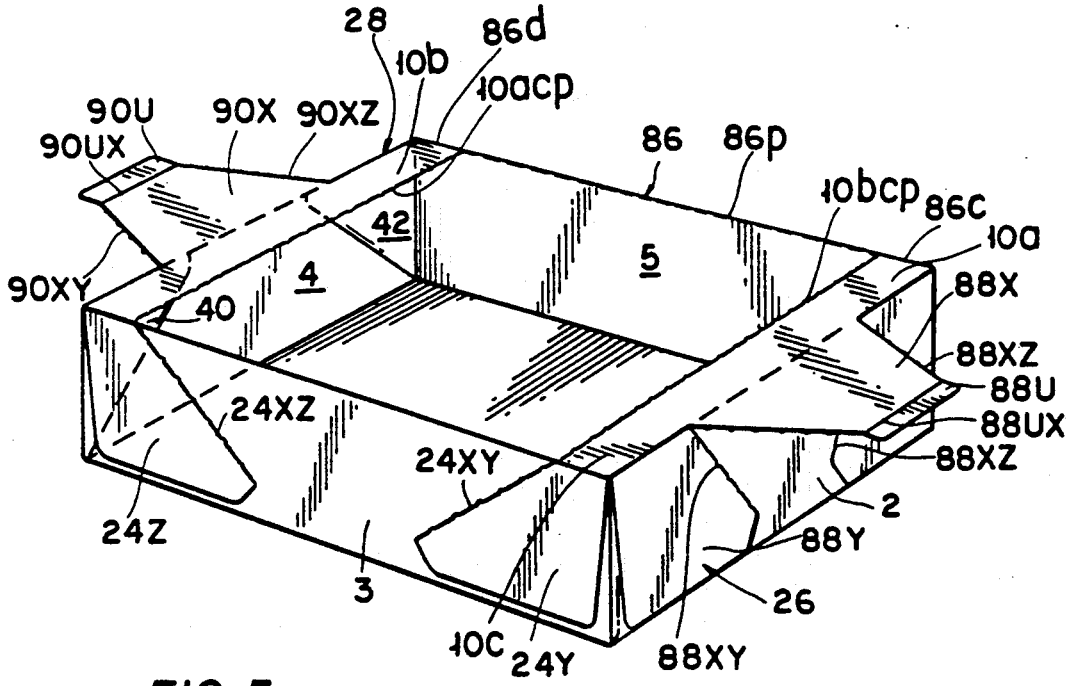
FIG. 5 is another perspective view of an end loaded carton in accordance with my invention in an assembled condition but with the top or lid closure portion completely removed so that the carton is open and access to the interior is provided and the top or lid closure portion is removed for ease of description; support braces and carry handles and lifting tabs therefor are provided for support and removal of the carton from the microwave oven are shown separated from and partially rotated out of the plane of the end portions.

Referring now to FIGS. 4 to 9 which show one preferred form of my invention. The carton as shown in FIGS. 4 to 6 generally show an end loaded carton provided with handles in accordance with my invention. The carton shown in FIGS. 8 and 9 shows a top loaded carton with handles in accordance with my invention. FIG. 7 shows a carton blank for a carton in its unassembled condition. Those elements of my invention as shown in FIGS. 4 to 6 and 8 and 9 in common with the prior art embodiments shown in FIGS. 1 to 3 will use the same reference numerals.

Referring now to FIG. 7 which shows a flat plane projection of a carton in the form of a board, from which my carton is developed. The carton includes a base member 1 and four bottom or base side members 2, 3, 4, and 5. Side member 3 is a front base side member, side member 5 is a rear base side member of substantially the same size and substantially parallel to the base front side member 3. Side members 2 and 4 are base side end members and are preferably parallel to each other in their assembles condition and are connected with base front and rear side members 3 and 5 and form therewith closures for the four sides. The adjacent side members are preferably orthogonal to each other. Side loading of the carton or container, as shown in FIGS. 4 to 6, takes place through one of shorter side members or base side end portions 2 or 4, as best seen in the partially assembled and loaded carton.

Connected with rear side base member 5 is a top closure or lid portion 10 comprised of a top front member or cover front side portion 24 and two top side members or cover side or end portions 88 and 90. Top front member 24 is of substantially the same size as and complementary to base front side member 3 and substantially overlies base front side member 3 in the closed condition of the container in a manner similar to member 11 in FIG. 3, and top side members or cover side or end portions 88, 90 are also complementary to and substantially overlie the base side end portions 2 and 4. End portions 88 and 90 replace the end portions 12 and 13 in FIG. 3.

A contents holding portion generally includes the base member 1, the four base sides 2, 3, 4, and 5 which are in a substantially orthogonal condition relative to base member 1 when in use in its assembled condition, and for this purpose score line 30 is provided between base member 1 and rear side 5, score line 34 is between base member 1 and front side member 3, score line 36 is between base member 1 and end side 2, score line 38 is between base member 1 and end side 4. Coupled between the bottom adjacent sides are inwardly turned corners or gables which connect the adjacent sides to each other. Specifically, inwardly turned corner 9 is coupled between sides 2 and 3, inwardly turned corner 40 is coupled between sides 3 and 4, inwardly turned corner 42 is coupled between sides 4 and 5, and inwardly turned corner 8 is coupled between sides 3 and 5.

For inwardly turned corner 9, score lines 34 and 36 are extended to the outer edges of bottom sides 2 and 3, respectively, along extension score lines 34a and 36a, to the edges of sides 2 and 3, respectively, and diagonal score line 9c is provided between side portions 9a and 9b of the inwardly turned flap or corner portion 9 to divide it into two substantially triangular portions.

In a similar manner, score lines 34 and 38 are extended along extension score lines to the outer edges of side walls 4 and 3, along extension score lines **34*b* and 38*b*, respectively, with score line 40*c* therebetween to separate inwardly turned corner 40 into two substantially triangular portions 40*a* and 40*b*. Extending from score lines 30 and 38 are extension score lines 30*a* and 38*a*, respectively, and score line 42*c* to divide inwardly turned corner flap 42 into two substantially triangular portions 42*a* and 42*b*. In a similar manner, score lines 36 and 30 extend along extension score lines 36*b* and 30*b*, respectively, to form inwardly turned corner 8 and score line 8*c* divides corner 8 into two substantially triangular portions 8*a* and 8*b***.

The top portion generally indicated in FIG. 7 with reference numeral 19 in accordance with the invention includes a top panel 10 which is substantially coextensive with bottom panel or base 1 and in a closed condition of the container is substantially parallel to bottom panel 1. Top panel 10 is connected with top front side member 24 and two top side end members 26, 28. Top side end members 26, 28 are preferably oriented in a parallel relation to each other when the carton is formed and orthogonal to top side member 24, with top side member 24 and the two top end members 26, 28 being orthogonal to the top panel 10.

It will be noted that top front side member 24 is very much similar to the front cover side portion 11 in the prior art containers shown in FIGS. 1 to 3. However, side members 26 and 28 or, more particularly, top side end members 26 and 28 are different from top side end members 12 and 13 in the prior art. These end members 26, 28 include lift handles in accordance with the invention, as will be described and explained further in detail.

Top panel 10 which overlies base portion 1 and top side member 24 is connected with and pivotable relative to top panel 10 to mate with front base side 3. Top panel 10 includes a center panel **10*c* and two side panels 10*a* and 10*b* and a first perforated or serrated portion 10*acp* between panels 10*a* and 10*c* and a second perforated or serrated portion 10*bcp* between panels 10*b* and 10*c* and which extends along the top of panel 10 in a substantially parallel direction to score lines 36 and 38 but are each inwardly displaced therefrom. While FIGS. 4 to 7 show perforations 10*acp* and 10*bcp*, it should be noted that these lines can be underscored as 10*ac* and 10*bc* as shown in FIGS. 1 to 3**. Use of perforations or underscoring is generally controlled by the intended utility of the container or carton.

The top panel 10 which is divided into three portions, the two top panel side portions **10*a* and 10*b* positioned on opposite sides of a center portion 10*c* with serrated or perforated line 10*acp* between panels 10*a* and 10*c* and serrated or perforated line 10*bcp* between panels 10*b* and 10*c*, performs some of the same functions as in the prior art container, but also performs additional functions in the present invention due to its relationship to other portions composing the top portion generally indicated with reference numeral 19. Panels 10*a* and 10*b* are preferably equal in width to each other and are substantially less than the width of panel 10*c*. The length of panels 10*a*, 10*b*, and 10*c* are preferably equal to each other. Panels 10*a* and 10*b* form two top side portions. While the serrated or perforated lines or separations 10*acp* and 10*bcp* are shown in a parallel relationship to score lines 36 and 38**, and are preferred, it should be noted that these do not have to be made in this manner but can be skew.

Side member 24 includes a first portion **24*x*, a second portion 24*y* and a third portion 24*z*. Lift tab 24T includes the first portion 24*x* and lift tab holder 24*u*. Lift tab 24T forms part of side portion 24 which is comprised of a center portion 24*x* of substantially trapezoidal shape and, connected with lift tab portion 24*u* of lift tab 24T and two front side sealing portions 24*y* and 24*z*. Serrated or perforated lines 10*acp* and 10*bcp* are connected with perforated portions 24*xz* and 24*xy*, respectively; and serrated or perforated portions 24*xz* and 24*xy* finish somewhat short of the end of the edge of side 24 to provide for lift tab 24T**.

Coupled between serrated or perforated portions **24*xy* and 24*xz* is lift tab 24T, which is comprised of the first portion 24*x* and lifting member or lift tab portion 24*u* which is free of and separated from side portions 24*y* and 24*z* and is pivotably connected with first lifting portion 24*x* along score line 24*ux*. First lifting portion 24*x* forms part of top front side member 24 and is separable therefrom by breaking the perforations 24*xy* and 24*xz* to enable the first portion 24*x* to separate from first side portion and second side portion 24*z* of top side member 24 and perform its opening function. Portions 24*y* and 24*z* are connected with the top panel portions 10*b* and 10*a*, respectively of the top panel 10 after top panel center portion 10*c*** is separated therefrom.

In order to open the top of the container, the lift tab 24T is raised and moved in such a manner that lift tab portion **24*u* causes the perforations or serrations or tear lines 24*xy* and 24*xz* to be broken to separate 24*x* from 24*y* and 24*z* and are separated along perforations 10*acp* and 10*bcp* to separate cover 10*c* from the top panel portions 10*a* and 10*b* to provide accessibility to the contents within the container. The top portion 10*c* is then pivoted along a connection line 86*p* which may be a score line as shown in FIGS. 1 to 3 (undesignated) or a perforated line as shown in FIGS. 4 to 7 to permit center panel 10*c* to be separated from rear base side 5 to provide access to the carton or container. Line 86 which divides or separates top portion 19 from the bottom portion is shown as perforated at 86*p* and, while not shown, it can equally well be scored so that top portion 10*c* can either remain attached or be removed and the container used as an open eating dish. Line 86*p* formed part of separation line 86 dividing top panel 10 and base rear side panel 5** from each other.

Line 86 is a connection and pivot between bottom side panel 5 and top panel 10. Line 86 generally includes cut portions **86*a* and 86*b* between inwardly turned corners 42 and 8, score or pivot portions 86*c* and 86*d* between top panel side portions 10*a*, 10*b* and base rear side 5 and perforated or scored portion (not shown) 86*p* between and in alignment with score pivot portions 86*c* and 86*d* and connecting top panel 10*c* and base rear side 5. Line 86 extends along cut lines 86*a* and 86*b* between flap portion 42*b* and 8*b*, respectively and 86*a* and 86*b* are cut during blank converting. Portions 86*c* and 86*d*** are only used as pivot connections when the carton blank is bent and formed into its carton configuration.

The side end portions 26 and 28 differ from top front portion 24 and perform different functions, even though structurally they generally appear to be the same.

Top end side portions 26 and 28 form handle mechanisms 88 and 90 with top cover 10. These handle mechanisms or members 88 and 90 differ from prior art carton end portions 12 and 13. Handle mechanisms 88 and 90 are used to seal the container or carton and for this purpose performs the same function as end portions 12 and 13, and when the contents are to be microwaved, the end portions 88 and 90 are structurally different from end portions 12 and 13 so that they can be used as handle mechanisms.

Handle mechanisms or members 88 and 90 are shown as identical and include holding members comprising handles 88*x* and 90*x* and lift tabs 88*u* and 90*u* connected therewith. Top side portions or handle mechanisms 88 and 90 are orthogonally related to lift tab 24T when folded and parallel to each other Handles 88*x* and 90*x* cooperate with top panels 10*a* and 10*b*, respectively, and panels 10*a* and 10*b* form strengthening ribs or braces for assisting in the support of the carton.

Side portions 88 and 90 are each composed of the handles 88*x* and 90*x* forming a center portion, together with side members 88*y*, 90*y* and 88*z*, 90*z* with perforations 88*xy* and 88*xz*, and 90*xy* and 90*xz* to separate adjacent portions. Once perforations or serrations or tear lines 88*xy* and 88*xz* are broken, then lifting handle 88*x* is separated from the remaining portion of the side portions 88*y* and 88*z* and 90*x* is separated from the remaining portions 90*y* and 90*z* of side 90 to form handles. Lift tab portions 88*u* and 90*u* assist in lifting the handles 88*x* and 90*x* and breaking the perforations, serrations or tear lines. Lift tab portions 88*u* and 90*u* are not connected by means of perforations to 88*y*, 88*z* and 90*y*, 90*z*. Lift tab portions 88*u* and 90*u* are connected to handles 88*x* and 90*x* by means of score lines 88*ux* and 90*ux* which is between them, respectively. When side portions of sides 88 and 90 are respectively sealed to sides 2 and 4, lift tab portions 88*u* and 90*u* are free of any sealing connection with sides 2 and 4 so that they can be easily lifted to separate handles 88*x* and 90*x* from side portions 88 and 90. Handles 88*x* and 90*x* together with the remaining portions of sides 88 and 90 may be glued to sides 2 and 4, but they should be readily separable therefrom so that they can be rotated out of a plane substantially parallel to sides 2 and 4 into a plane substantially parallel to top panel 10.

These handles are comprised of a single member provided with perforations 88*xy*, 88*xz*, 90*xy* and 90*xz* to provide a three-part unit when the perforations, serrations or tear lines are broken and to divide the handle members 88 into three portions 88*x*, 88*y* and 88*z*, with portion 88*x* forming the handle portion connected to the free portion 88*u* which forms the lift tab portion and forming one of two handles for holding the container.

Top end member 26 at side member 88*y* is cut along score line 86 starting from score line portion 86*c* between flap or gable portion 8*b* and side 88*y* along cut portion 86*b*. In a similar manner, top end member 28 is cut along line 86 between side member 90*y* and triangular flap portion 42*b*. Both side members 88*y* and 90*y* are cut on a diagonal from score lines 108 and 110 to their free ends to provide for an increased spacing in the flat plane projection adjacent to triangular flap portions 8*b* and 42*b*, respectively.

In a similar manner, side 28 is provided with perforations or serrations 90*xz*, 90*xy* to divide the side member 28 into three portions, including side portions 90*y* and 90*z*, and a center handle portion 90*x* which is connected with lifting tab 90*u*. Score lines 26*a* and 28*a* are connected respectively with and extend from score lines 36 and 38 in order to form a uniform square or rectangular package.

As in the prior art, the carton blank and the carton made therefrom have the side edges on flap portions 9*a* and 9*b* formed so that they do not meet at a point forming the edge of a right angle extending from score line 9*c*, but are provided with a notched portion 9*d* in which a triangular portion has been removed to provide for ease in folding and assembling of the container. In a similar manner, all four side portions have a triangular portion removed to leave notched portions 40*d*, 42*d* and 8*d* to provide for ease of assembly.

The flat plane projection of the carton blank shown in FIG. 7 shows a flat plane projection of the carton blank useful for both an end load and top load carton. There may be a few minor variations which are necessary for a side loaded carton, but such variation does not affect the handles 88*x* and 90*x* or the lift tab portions 88*u* and 90*u*.

In FIG. 4, the entire container is shown in a sealed condition as one would purchase it from a store with the food contained therein. All of the reference numerals have not been included, but the lift or support handles and lift tabs are shown in their condition when not in use. FIG. 5 shows the carton with the top flap 10*c* completely removed and the lifting handles 88*x* and 90*x* separated from ends 26 and 28, along perforations 88*xy* and 88*xz*, 90*xy* and 90*xz*, respectively. Top panel 10 is shown forming a unitary part with panel 24*x* in FIG. 4 and with side 5 in FIG. 5 connected thereto along score lines 86*c* and 86*d*, and serrations or perforations 86. Perforations 10*acp* and 10*bcp* are shown after top panel portion 10*c* is removed or separated from sides 10*a* and 10*b*.

As shown in FIG. 6, food can be loaded into the containers through the end openings and then sealed. Corner gable flaps 8, 9, 40 and 42 are shown before being plowed inwardly as in FIG. 4. This operation rotates the lower end flaps 2 and 4 to a vertical position relative to the bottom base 1. The top end flaps 26 and 28 are subsequently rotated down along score lines 108 and 110 so that top panels 26 and 28 each respectively overlie lower panel flaps 2 and 4. The upper and lower flaps are then heat sealed to close the carton together.

When loading a carton made from a blank according to the invention, one end, the end opposite or remote from the loading direction is sealed in the normal conventional way. Then the other end is loaded and sealed. During the sealing procedure, and top side flap 26 is sealed to bottom side 2 (FIGS. 1 and 2) in a conventional way.

Referring to FIGS. 8 and 9 which show a top loaded carton made from a blank shown in FIG. 7, and the carton is substantially the same as the carton shown in FIGS. 4 to 6. In the top loaded carton as shown in FIG. 9, the center panel 10*c* is separated from side panels 10*a* and 10*b* by underscoring 10*ac* and 10*bc*, as shown, although the separation can take place equally well with the use of perforations or tear lines as shown in FIGS. 4 to 6.

FIG. 8 shows perforations, but this can equally well be a tear line or an underscored portion.

The top cover can be removed during microwaving, if desired. For this purpose, the top cover can be connected with perforated portions. In a preferred embodiment, the top side flaps which overly the bottom side ends are made slightly shorter than the bottom side ends. The carton is closed and sealed with the lifting handles 88*x* and 90*x* in an open position as distinguished from opening member 24*x* which is sealed to the bottom front end 3. Nevertheless, during sealing 88*y* and 88*z*, and 90*y* and 90*z* are sealed to sides 2 and 4, respectively.

For certain purposes, lifting handles 88*x* and 90*x* may also be sealed to sides 2 and 4, respectively; however, 88*u* and 90*u* are not sealed to sides 2 and 4, so that handles 88*u* and 90*u* may be easily removed from a connection with sides 2 and 4 and be used as handles.

While there has been shown and described what is considered to be the preferred embodiments of the invention, various changes and modifications may be made therein without departing from the scope of the invention.

I claim:

1. A carton for containing food suitable for microwaving, comprising:

a pair of spaced end walls coupled with a base;

a top closure wall including coupled thereto a side wall for each said end wall of said pair of end walls adapted to fit over said pair of end walls;

perforation means on each of said side walls for dividing said side walls into first and second portions; and sealing means for sealing said side walls to said end walls and leaving said second portions partially free of sealing engagement with said end walls;

said perforation means enabling said second portions to be separated from said first portions to form handles for supporting said carton.

2. The carton as claimed in claim 1, wherein said top closure wall includes underscoring means for underscoring a top portion thereof to provide a pair of first portions coupled with said side walls and a second portion separable from said first portions at said underscoring means to provide access to an interior part of said carton adapted to contain the microwavable contents.

3. The carton of claim 1, wherein each of said second portions of said side walls includes a first member forming a lift tab and a second member forming a handle, said handle being pivotable from a first position juxtaposed to said end walls to a position substantially parallel to a plane of said top closure.

4. The carton of claim 3, including means for holding said handle to its adjacent end wall when juxtaposed thereto.

5. The carton of claim 3, including scoring means between said lift tab and said handle to permit said lift tab to be pivoted away from its adjacent end wall to effect leverage onto said handle for separation thereof from said end wall adjacent thereto.

6. The carton of claim wherein said perforation means includes a pair of spaced perforations or serrations to divide each of said side walls into a first or middle portion and second and third side portions on opposite sides of said middle portion, said middle portion after separation along said perforations or serrations from said second and third portions being movable from a first plane adjacent to said end wall to a second plane substantially co-planar with said top closure wall.

7. The carton of claim 6, wherein said top closure wall includes a pair of spaced underscored portions for dividing thereof into a center portion and two adjacent top side portions and to permit said center portion to be separated from said top side portions, said top side portions being connected with said side walls and forming braces for said side walls and cooperating with said middle portion when used as carrying members for said carton.

8. The carton as claimed in claim 1, including:

food containing means including a tray portion having a pair of said spaced end walls;

support means including said handles for said food containing means including said sealing means for sealing said tray portion to prevent contamination thereof, said sealing means including cover means;

said support means including said handles forming part of said sealing means for sealing said handles with said end walls;

said handles including holding means and lift means;

said holding means including first means adjacent to said end walls in a transport condition of said tray portion and second means forming part of said cover means and pivotally connected with said first means, said first means being pivotable relative to said end walls for movement away therefrom towards said second means for support of said tray portion.

9. The carton of claim 8, wherein said support means includes portions of said cover means and wall means connected therewith including said first means, said wall means including spaced perforation means for dividing said wall means into said first means and a pair of end wall means adapted to be sealed to said pair of spaced end walls.

10. The carton of claim 9, wherein said cover means includes underscored means dividing thereof into an openable cover portion for said tray portion and a pair of supports forming with said holding means said handle means; scoring means connecting said supports with said handle means to permit said holding means to pivot relative to said supports.

11. A carton blank for forming a microwavable container, comprising a single blank element, including:

a base member and four base side members coupled thereto, score lines between each of said side members to permit said side members to pivot relative to said base member;

a top portion and two top end side members pivotally coupled thereto, said top portion having a rear side between said two top side members pivotally connected to one of said four base side members;

each of said two top end side members including a pair of spaced tear lines to divide said two top end side members into a first portion for lifting a carton formed from said carton blank and a second portion adapted to be connected with two others parallely spaced from each other of said first four base side members and orthogonal to the others of said base side members.

12. The carton according to claim 11, including a first portion score line on each of said first portions to divide said first portion into a lift member and a support member, said lift member being pivotable relative to said support member about said first portion score line.

13. The carton blank according to claim 11, wherein said top portion includes a pair of underscored means forming spaced tear lines for dividing thereof into a center portion and two top side portions spaced from each other, said top side portions being connected with said top end side members and forming therewith top ribs or braces to aid in the support of the carton.

14. The carton according to claim 13, including a score line between said top side portions and said top side end members to enable thereof to pivot from a plane orthogonal to said top portion into a position substantially parallel thereto.

15. The carton blank according to claim 14, wherein said score lines are parallel to said tear lines.

16. The carton blank according to claim 14, including dividing each of said end top side members into four cooperating portions, including first and second portions to form a lift tab and a handle, said first and second portions being pivotally connected together, and third and fourth portions connected to said handle but free of said lift tab, and perforations separating said handle from said third and fourth portions.

17. A carton for containing food suitable for microwaving, comprising:

a pair of spaced end walls coupled with a base;

a top closure wall including coupled thereto a side wall for each said end wall of said pair of end walls adapted to fit over said pair of end walls;

serration or perforation means on each of said side walls for dividing said side walls into first and second portions; and sealing means for sealing said side walls to said end walls;

said serration or perforation means enabling said second portions to be separated from said first portions to form handles for supporting said carton.

18. The carton of claim 17, wherein said perforation or serration means includes a pair of spaced perforations or serrations to divide each of said side walls into a first or middle portion and second and third side portions on opposite sides of said middle portion, said middle portion after separation along said perforations or serrations from said second and third portions being movable from a first plane adjacent to said end wall to a second plane substantially coplanar with said top closure wall.

19. The carton of claim 18, wherein said top closure wall includes a pair of spaced underscored portions for dividing thereof into a center portion and two adjacent top side portions and to permit said center portion to be separated from said top side portions, said top side portions being connected with said side walls and forming braces for said side walls and cooperating with said middle portion when used as carrying members for said carton.

20. The carton of claim 17, wherein said top closure wall includes a pair of spaced perforated portions for dividing thereof into a center portion and two adjacent top side portions and to permit said center portion to be separated from said top side portions, said top side portions being connected with said side walls and forming braces for said side walls and cooperating with said middle portion when used as carrying members for said carton.

* * * * *